US006173534B1

(12) United States Patent
Dupin

(10) Patent No.: US 6,173,534 B1
(45) **Date of Patent: *Jan. 16, 2001**

(54) ENTRY DOOR

(75) Inventor: Marcel Dupin, Saint-Gilles Croix de Vie (FR)

(73) Assignee: Bel'm Productions Sarl, Machecoul (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/951,793

(22) Filed: Oct. 16, 1997

(30) Foreign Application Priority Data

Jun. 10, 1997 (FR) ..... 97 07393

(51) Int. Cl.[7] ..... E06B 3/00
(52) U.S. Cl. ..... 49/501
(58) Field of Search ..... 49/501; 52/582.1, 52/579, 578, 782.1, 783.1, 784.1, 784.11, 796.1, 800.12, 800.13

(56) References Cited

U.S. PATENT DOCUMENTS

| | | | | |
|---|---|---|---|---|
| 2,165,430 | * | 7/1939 | Weisfeld | 52/784.11 |
| 2,228,650 | * | 1/1941 | Young et al. | 52/579 X |
| 3,506,088 | | 4/1970 | Sherman . | |
| 4,571,915 | * | 2/1986 | Barman | 52/784.11 |
| 4,589,240 | * | 5/1986 | Kendall et al. | 49/501 X |
| 4,937,978 | * | 7/1990 | Johansson et al. | 49/501 X |

FOREIGN PATENT DOCUMENTS

| | | | |
|---|---|---|---|
| 1509 523 | | 6/1969 | (DE) . |
| 2505 395 | | 11/1982 | (FR) . |
| 2539 803 | | 7/1984 | (FR) . |
| 471258 | * | 9/1937 | (GB) . |
| 2005 331 | | 4/1979 | (GB) . |

* cited by examiner

*Primary Examiner*—Jerry Redman
(74) *Attorney, Agent, or Firm*—J. Warren Whitesel; Laf Whitesel & Saret, Ltd.

(57) ABSTRACT

The present invention relates to an entrance door to premises. The entrance door (1) according to the invention is provided to have one of its faces (15) turned toward the inside of said premises, where the temperature deviations are limited over time, and its other face (38) turned toward the outside of these premises, where the temperature deviations are more important, said door being equipped with a guide (6) to guide it into displacement relative to a wall frame (5) on which is it mounted, and (3) to close it on said wall frame (5). Said door (1) is made up of two panels (9 and 10) that are connected together in superposition and in a zone of their faces that face each other (20 and 37*a*), said guides (3 and 6) being mounted on the panel (9) and meant to have its external face (15) turned toward the inside of said premises.

6 Claims, 4 Drawing Sheets

ENTRY DOOR

BACKGROUND OF THE INVENTION

The present invention relates to an entrance door for a premises, and more particularly to a door that has one of its faces turned toward the inside of the premises where temperature deviations are limited over the course of a year, and its other face turned toward the outside of said premises, where the temperature deviations are more important.

It is well known that the entrance door face that is turned toward the inside of premises, and characterized by a limited yearly thermal amplitude, undergoes only a limited expansion/contraction in the course of a year. On the other hand, it is also true that the face of that same door that is turned toward the outside of the premises may be subjected to a relatively important expansion/contraction, because of external temperatures that vary, for example, between −10° C. and 40° C. over the year.

This expansion/contraction phenomenon of the external face of an entrance door is further accentuated when that face is made of a metallic material, especially aluminum.

Entrance doors with metal faces generally can be divided into two groups, depending on their structure.

The first group the most commonly used doors, which are made of one or several decorative panels a thermally insulating packing, that are mounted inside a door frame is made of metallic profiles, for example. These panels comprise, on each one of their faces, a metallic facing possibly of aluminum. The thermally insulating packing of these panels is made of polyurethane, for example.

These doors offer the advantage of having reduced expansion/contraction characteristics for their respective external faces, in response to important yearly variations of the outside temperature. Such door, however, come at a rather high cost, and with a less than a perfect aesthetic appearance.

In a second group, there are monoblock doors that usually are made up of a single panel with a thermally insulating packing that is connected so as to form one piece with a frame. This panel and this frame comprise metallic facings that form the faces of the door. Each facing is mounted directly on the above-mentioned frame. The latter is equipped on its respective longitudinal edges, on the one part with means to guide the door when in motion relative to a wall frame, and on the other part, to close it when in a and possibly lock it into closed position.

A major drawback of a door of the monoblock type is found in that this external facing, when it expands/contracts along its periphery because the afore-mentioned yearly thermal temperature variations, exerts stresses on the frame and which becomes deformed, this bringing about difficulties, even possibly the impossibility of a closing of the door.

BRIEF SUMMARY OF THE INVENTION

The purpose of the present invention is to provide an entrance door having one of its faces turned toward the inside of these premises, in which the temperature deviations are reduced over time, and its other face turned toward the outside of these premises, where the temperature deviations are greater. This door is equipped with means to guide it in motion relative to a wall frame on which it is to be mounted, and with means to close it on this frame. The door is such that its external face can not hinder the opening or the closing of this door because of its expansion/contraction.

To that end, an entrance door according to the present invention is made up of two panels that are joined together in superposition and over a zone of their faces facing each other, with means to render the door movable and to close it. The means are on the panel having its external face turned toward the inside of the premises.

According to another characteristic of the invention, said joining-together zone is central relative to the periphery of the panels.

According to another characteristic of the invention, these panels respectively comprise, on the periphery of the faces that face each other, means to permit the displacement of the edges of the panel to have its external face turned toward the outside of the premises, and in a plane parallel to that of that internal panel.

According to another characteristic of the invention, the above-mentioned means are made up of identical profiles in the form of small flaps which the above-mentioned panel faces that face each other respectively have over their entire length and their entire width, so that the flap of the external panel is capable of sliding on the corresponding flap of the internal panel, in the direction of the length and of the width of the door.

According to another characteristic of the invention, each flap is made up of two flat portions of equal width that are parallel to the panel faces that face each other. The flat portions are connected together by means of an oblique portion.

According to another characteristic of the invention, the panels are joined with each other by means of a cross piece on which there are fixed the respective median parts of the panels.

According to a variant of the invention, the panels are joined together by means of a layer of glue that is applied to their respective median parts.

The above-mentioned characteristics of the invention, as well as others, will appear more clearly upon reading of the following description of an example of execution, this description being given in relation to the attached drawing, in which:

DETAILED DESCRIPTION OF THE DRAWINGS

Figure 1:
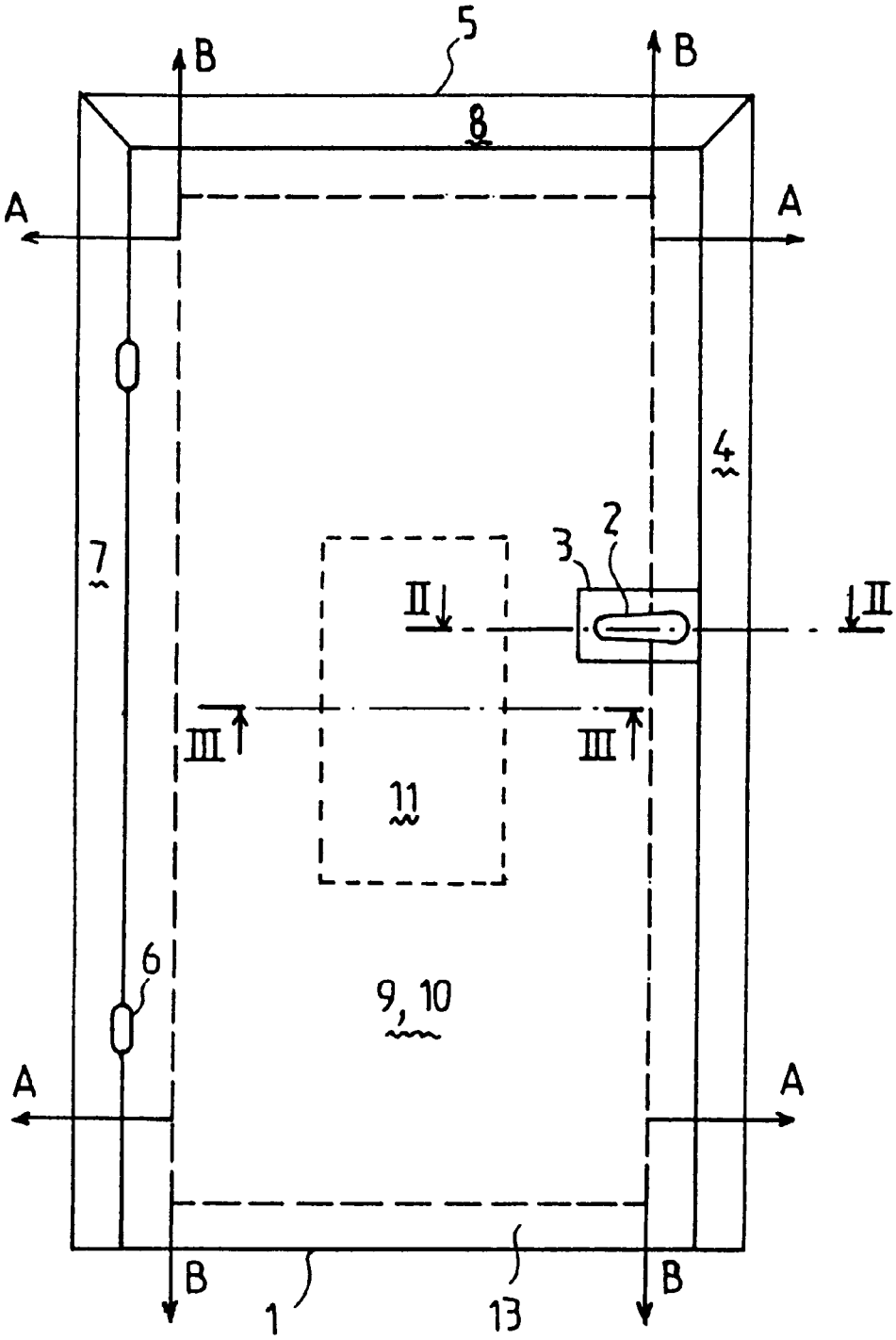
FIG. 1 is a front view of an inventive entrance door to a premises which is mounted in a wall frame.

There is shown in FIG. 1 an inventive entrance door 1 comprising a handle 2 provided to govern closing means and possibly locking means in closed position. The handle and lock are mounted facing one vertical frame member 4 of wall frame 5. Hinge means 6 guides the door 1 in motion relative to said wall frame 5 the hinge means are mounted on the other vertical member 7 of wall frame 5. The means 3 and 6, respectively, are symbolized by a lock 3 and hinges 6, in the general picture in FIG. 1. A lintel 8 of the wall 5 is mounted between the vertical frame members 4 and 7.

The present invention, however, also applies to a door 1 equipped with means 6 of any other type, to guide it around the wall frame 5. The door 1 could be planned, for example, to be mounted for sliding in guiding means 6 constituted by a slider, as by means of small wheels.

The door 1 is made up of two approximately equal panels 9 and 10, that are joined with each other in superposition by a means 11, in a given zone. Means 11 is shown in dotted lines in FIG. 1.

Hereafter, in the present description, panels 9 and 10 are called internal panel and external panels that respectively face toward the inside and toward the outside of the premises under consideration.

The internal panel 9 is made of a frame 13 on which there is mounted an insulating plate 14 (FIG. 2) and an internal facing 15 that is made with the frame 13 and the plate 14.

The frame 13 comes and to lodges in the rabbet 16 of the wall frame 5 which is made of profiles, such as aluminum m profiles.

The frame 13 further comprises an internal part 17 with an L-shaped section, on which the plate 14 is mounted by one of its edges 18, by gluing, for example.

Each profile 13 further comprises an external part 19 that is mounted on one of faces 20 of plate 14, that extends the internal part 17 at a right angle.

The internal part 17 is made up, starting from its free end the most distance from plate 14, with a first portion 21 having a U-shaped section, that is extended into one of its cores and into one of its wings, by a second portion 22 with a rectangular section, the width of which is equal to the height of the mentioned first portion 21.

Each second portion 22 is extended at a right angle by a third portion (23, also rectangular, which extends in one of its faces by means of a fourth portion 24 with a U-shaped section, one wing of which is constituted by the above-mentioned face. The other wing of the fourth portion 24 is equipped on its external face and at a right angle, with two parallel tabs that form a fifth portion 25 with a U-shaped section.

Each first portion 21 that is meant to be mounted facing either vertical member 4 or lintel 8 of the wall frame 5 is receives a tightness joint or whether strip 26. Each joint 26 is takes its support on the internal face 27 of the wall frame 5 when the door 1 is in closed position.

Each fifth portion 25 is finds itself facing the recessed face 28 of the corresponding rabbet 16, to receive a tightness joint or whether strip 29. Each joint 29 is its support on the recessed face 28 of the rabbet 16, when the door 1 is in a closed position.

The second and third portions 22 and 23 give the corresponding internal profile 17 a high inertia module, which allows it to withstand important flexion stresses without a significant deformation.

The fourth portion 24 that is facing the vertical wall frame member 4 of the wall frame 5, at the time the door 1 is mounted on the latter, comprises shoulders 24*a* that receive an end section 12*a*. The latter is planned to receive the sliding part 12 of the closing means 3.

It will also be noted that the fourth portion 24 that is facing the other vertical member 7 of the wall frame 5 is planned so that the guiding means 6 will run through it.

Figure 2:
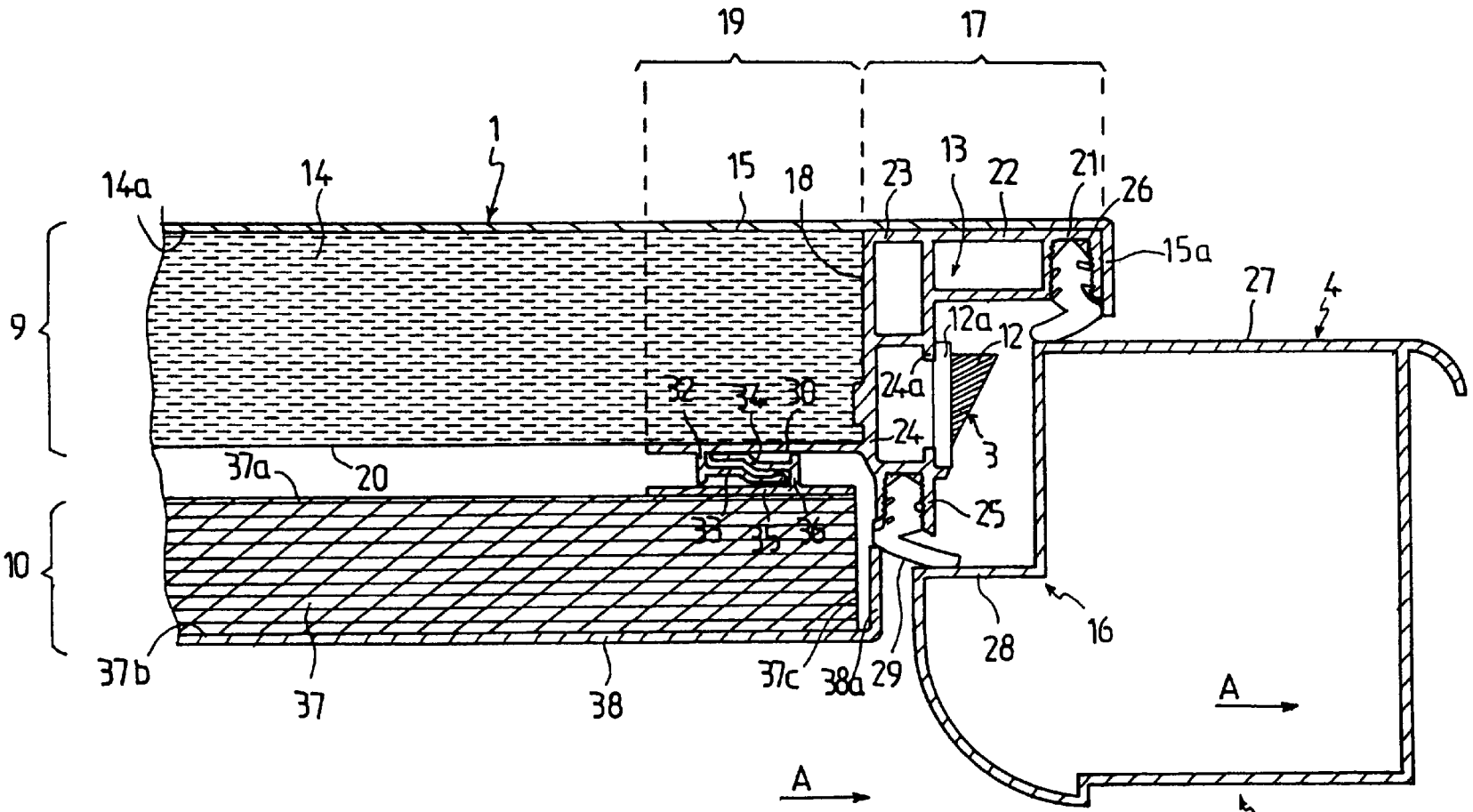
FIG. 2 is a partial view, in section along plane II—II in FIG. 1, of an entrance door according to the invention and of a vertical frame member of the indicated wall frame.

As it may be seen in FIG. 2, the third and fourth portions 23 and 24 are characterized by a length that determines the thickness of the plate 14, so that the latter is mounted in contact with the entire flat face common to these portions 23, 24.

Each insulation plate 14 is made up of synthetic material, preferably of a thermally insulating cellular material of the polystyrene foam type, such as Styrofoam (R).

Once plate 14 is mounted on frame 13 by means of its edges 18, the facing 15 is connected, by gluing for example, on one side with the first two portions 21, 22 and one face of the third portion 23 of this frame 13 and, on the other side, with the face 14*a* of plate 14 that is mounted flush with number 14.

As it may be seen in FIG. 2, the facing (15) is, for example, bent into a right angle at each one of its edges 15*a*, and each edge 15*a* fits, except for mounting play, with the external face of each first portion 21 facing it.

The external member 19 of each profile 13 comprises a flat base 30 on which there is mounted, by its periphery, the part of face 20 of plate 14 that is adjacent to the above-mentioned edge 18. The base 30 is equipped with a right angled tab 32 from which there extends a flap 33 approximately parallel to said base 30. In the present example, the flap 33 is made of two flat portions of the same width and parallel to base 30, that are connected together by means of an oblique portion.

The flap 33 is provided to cooperate with an identical flap 34 which the external panel 10 comprises, and that is connected, to a base 35 by a tab 36.

This external panel 10 is made of an insulation plate 37, on the periphery of one of the faces 37*a* of which there is mounted base 35 equipped with the tab 36 and the flap 34, and of an external facing 38 made to form one piece with the other face 37*a* of plate 37, by gluing for example.

Once the internal panel 9 has been assembled in the afore-mentioned manner. The flap 34 of each base 35 is set into place on flap 33 of each corresponding base 30, so that flap 34 is positioned parallel to flap 33, being practically in contact with it, with the needed play. Moreover, the tab 36 of the flap 34 and the end of flap 33 must be practically tangent, with the needed play.

As it may be seen in FIG. 2, the flat portions of a flap 34 are mounted precisely facing the flat portions of the flap 33 that faces it.

Each pair of flaps 33, 34 exerts a unique function, that is to forbid the displacement of the panel 10 in a direction perpendicular to panel 9, while it does not hinder the displacement of the panel 10 in directions parallel to the plane of panel 9.

Figure 3:
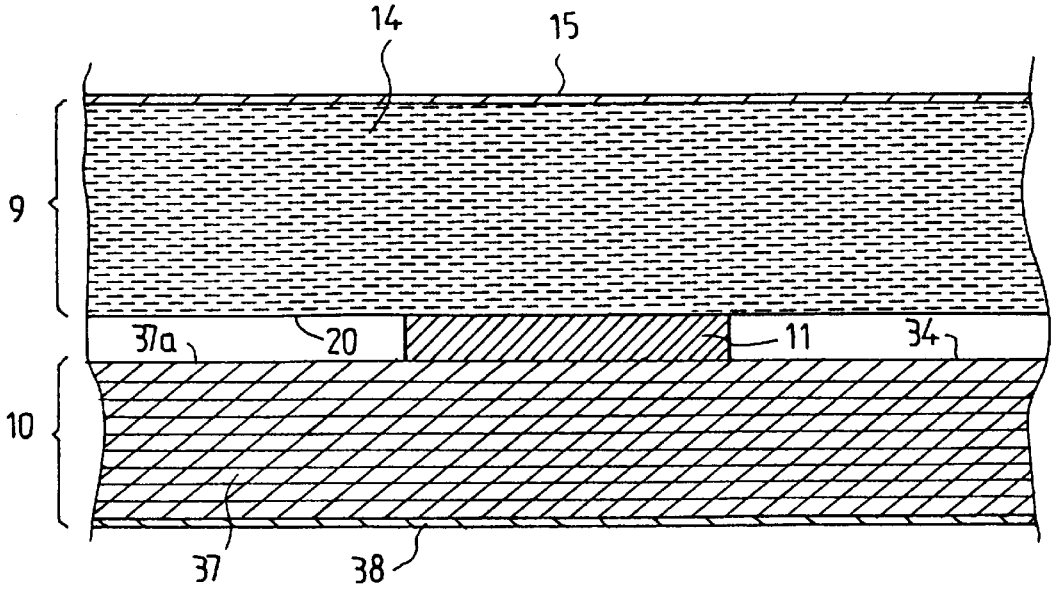
FIG. 3 is a partial view of the mentioned door, in section along plane III—III in FIG. 1.

The insulation plate 37 is connected, on the one part with each base 35, for example, and on the other part with the face 20 of the insulation plate 14 by the means 11 (FIG. 3). As it may be seen in FIG. 3, this means 11 is made of a crosspiece, for example. In the present example, the plates 14 and 37 are glued to this cross piece 11. The latter has a square shape, for example, its center being that of the plates 14, 37.

It will be noted that the insulation plate 37 preferably is constituted of a synthetic material that has an "alveolate" structure, for example. This material gives the external panel 10 a mechanical resistance with satisfactory compression. In this example, the thickness of plate 37 is less than the thickness of plate 14.

The facing 38 is then made as one with said face 37*b* of the insulation plate 37.

As it may be seen in FIG. 2, the facing 38 has edges 38*a* bent at a right angle. Each elbowed edge 38*a* is fits against an edge 37*c* of the plate 37, with necessary play. This latter play is provided to create a thermal bridge in panel 10, once that panel has been assembled onto the panel 9.

The door according to the invention reacts in the following manner to the surrounding temperature variations.

The inside temperature of the premises to which the door 1 gives access, usually ranging between 15 and 25° C., approximately, in the course of a year. As a result of the limited amplitude of the inside temperature, the facing 15 of the internal panel 9 suffers practically no expansion/contraction over the year.

The external panel 38, is subjected to important temperature deviations in the course of a given year, the temperature possibly varying between −10° C. and 40° C. for example. From this temperature variation facing 38 can undergo significant expansion/contractions in the course of a given year, in opposition to facing 15.

Now, each flap 34 of the external panel 10 is provided so that it can slide over the corresponding flap 33 of the internal panel 9, by means of the flat portions of the flaps 33, and 34. This sliding is in the direction of the width and of the length of these flaps 33 and 34 (see arrows A and B respectively in FIGS. 1 and 2), when the external facing 38 becomes expands/contracts.

On the other hand, the displacement of each flap 34 in a direction perpendicular to the plane of panel 9 is hindered, because of the assembling the above-mentioned flaps 33 and 34, are practically in contact with each other.

As a result, the periphery of the external panel 10 can move in a same plane relative to internal panel 9 at the time of the expansion/contraction of the facing 38. Without this, in the long run , the expansion/contraction causes the deformation of the frame 13 of door 1, on which the means 3 and 6 are mounted to guide the door and to close it.

As a consequence, the door 1 according to the invention does not show opening and closing defects over the course of a given year.

The afore-mentioned sliding does not cause the external facing 38 to become convexly deformed, as a result of a reaction to the stress that frame 13 might exert on its edges 38*a*.

With respect to the afore-mentioned sliding in the direction of arrows A, it will be noted that its maximal authorized amplitude is pre-defined by the width of each flat portion of a flap 33, 34. Indeed, the distance between two of the same portions of flaps 33 and 34 facing each other is constant because of the crosspiece 11 limiting the afore-mentioned relative sliding of these flaps 32 over the width of a flat portion.

It will be noted that the use, for the external insulating plate 37, of a material of the "alveolate" type makes it possible to give do or 1 a good mechanical holding with respect to compression stresses to which it is subjected in the closing position.

Figure 5:
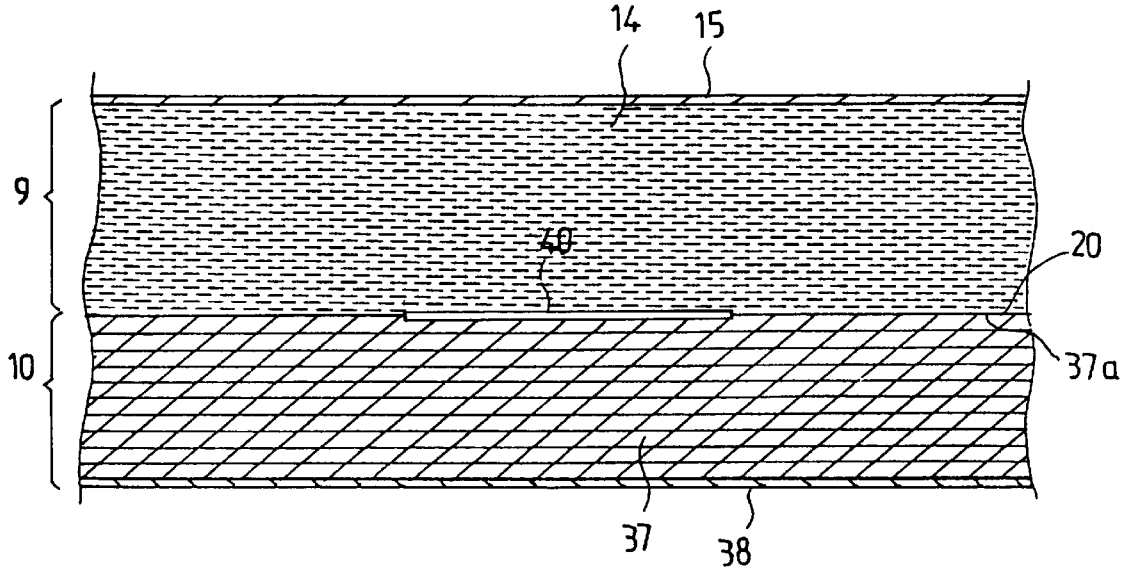
FIG. 5 is a variant of execution of the door part shown in FIG. 3.
Figure 4:
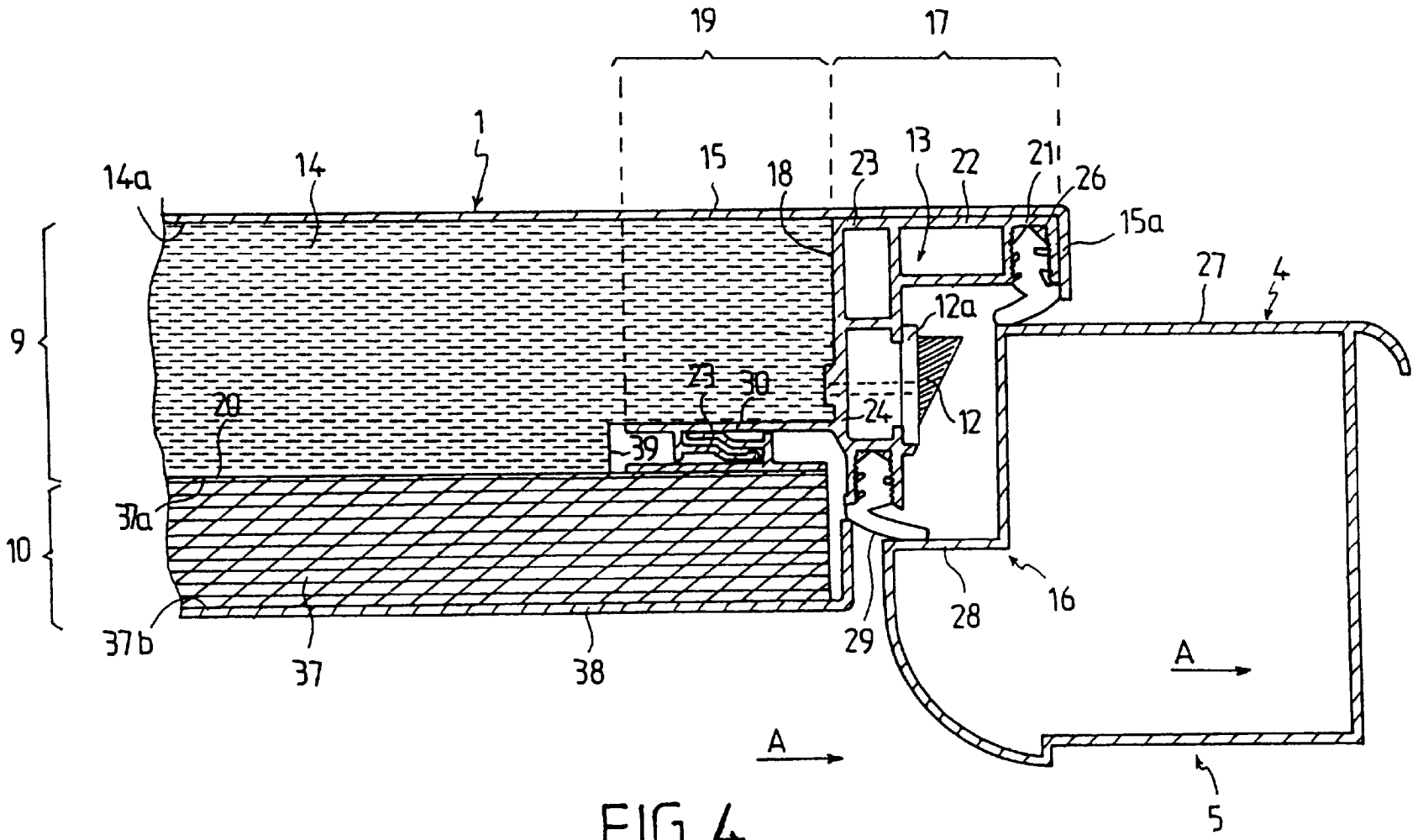
FIG. 4 is a variant of of the door part shown in FIG. 2.

In FIGS. 4 and 5 show a variant embodiment of door 1 that has just been described. The elements relating to this variant that are identical with those mentioned above are identified with the same references.

This variant differentiates itself from the afore-mentioned door 1 essentially in the shape of the internal insulation plate it comprises.

As it may be seen in FIG. 4, plate 14 has a rectangular section, except at the periphery of its face 20 that is meant to be made one with the external insulation plate 37. This face 20 shows cut-outs 39 in the form of rabbets on the recessed faces of which the bases 30 equipped with the flaps 33 are mounted. The two plates 14 and 37 are mounted on each other, except at the location of the above-mentioned cut-outs 39.

It will be noted that, in this variant, the plate 37 could comprise the afore-mentioned cut-outs in relation with plate 14, plate 14 presenting, for its part, an integrally rectangular section.

According to this variation, the plates 14 and 37 are joined together as one by means of at least one glue zone 40 centered on the respective centers of these plates 14 and 37, in the variation in FIG. 5.

It will be noted that door 1 according to the invention could also be constituted of non-metallic material, moreover, it could be equipped on each one of its facings 15, 38 with decorative motives, such as ribs or metal panels.

What is claimed is:

1. An entrance door for a premises, said door having one of its faces (15) turned toward an inside of said premises, where temperature deviations are relatively small over time, and its other face (38) is turned toward an outside of said premises where temperature deviations are higher, said door being equipped with means (6) to guide it into motion relative to a wall frame (5) on which it is meant to be mounted, and with means (3) to close it on said wall frame (5), said door having panels (9 and 10) that are joined together in superposition, and in a zone of their faces that are facing each other (20 and 37*a*), said means (3 and 6) being mounted on one of said two panels (9) and having its external face (15) turned toward the inside of said premises, said panels (9 and 10) respectively comprising at the periphery of their faces (4*b* and 37*a*) facing each other, means (3 and 34) to enable a displacement of the edges (18) of the panel (10) having its external face (38) turned toward the outside of said premises, relative to said internal panel (9) and in a plane parallel to the plane of said internal panel (9), said means (33 and 34) to enable the displacement of the edges (18) of the external panel (10) being made of identical profiles in the shape of flaps facing each other, said flaps being distributed over the entire width and the entire length of said faces (14*b* and 37*a*) of said panels (9 and 10), said flaps (33, 34) being parallel to said faces (14*b* and 37*a*) that face each other and practically in contact with each other, each flap (34) of the external panel (10) being positioned to slide over a corresponding flap (33) of the internal panel (9) with the sliding in the direction of the length and the width of the door (1).

2. An entrance door (1) for a premises, said door having one face (15) turned toward an inside of said premises where temperature deviations overtime and are slight and another face (38) turned toward an outside of said premises where temperature deviations over time are great, mounting means (6) for guiding said door motion relative of a supporting structure (5) on which it is mounted, means (3) for closing said door on said supporting structure, said door comprising two panels (9 and 10) that are joined together in superposition in a zone where their faces (20 and 37*a*) confront each other, said closing and mounting means (3 and 5) being mounted on panel (9) having the external face (15) turned toward the inside of said premises, said panels (9 and 10) respectively having a periphery of confronting faces (4*b* and 37*a*) within means (33 and 34) for enabling a displacement of edges (18) of panel (10) with respect to said other face (38) turned toward the outside of said premises and in a plane parallel to a plane of said internal panel (9), said means (33 and 34) for enabling the displacement of the edges (18) of the external panel (10) having substantially identical profiles in the shape of flaps that extend over an entire width and length of faces of said panels (9 and 10), said flaps being parallel to said faces (14*b* and 37*a*) and to each other and in approximate contact with each other so that each flap (34) of the external panel (10) can slide over each corresponding flap (33) of the internal panel (9), with said sliding being in the direction of the width of the length of the door (1).

3. The entrance door of claim 2 wherein said zone is in a central location relative to the periphery of said panels (9 and 10).

4. An entrance door according to claim 2, wherein each of said flaps (22, 34) has a flat portion, said flat portions of said flaps having approximately the same width and being parallel to the confronting faces (14*b* and 37*a*) of said panels (9, 10), said flat flaps being connected with said panels by means of an oblique portion.

5. An entrance door according to claim 2 wherein median parts of panels (9 and 10) are joined together by a cross piece (11).

6. An entrance door (1) according to claim 2 wherein median parts of panels (9, 10) are joined together by means of a layer of glue (40).

* * * * *